US005243777A

United States Patent [19]

Dedlow

[11] Patent Number: 5,243,777

[45] Date of Patent: Sep. 14, 1993

[54] PICTURE FRAME

[76] Inventor: David Dedlow, P.O. Box 4666, Glendale, Calif. 91222

[21] Appl. No.: 797,030

[22] Filed: Nov. 25, 1991

[51] Int. Cl.[5] ..... A47G 0/1
[52] U.S. Cl. ..... 40/152.1; 40/156
[58] Field of Search ..... 40/152.1, 152, 156

[56] References Cited

U.S. PATENT DOCUMENTS 2,954,630 10/1960 Hull ..... 40/152.1
3,900,979 8/1975 Eggenshwiler ..... 40/152.1

FOREIGN PATENT DOCUMENTS 2331364 1/1975 Fed. Rep. of Germany ..... 40/156
3302820 8/1984 Fed. Rep. of Germany ..... 40/152

*Primary Examiner*—Kenneth J. Dorner
*Assistant Examiner*—Cassandra Davis
*Attorney, Agent, or Firm*—J. E. Brunton

[57] ABSTRACT

A picture frame construction in which one side of the frame is removably secured in place by a uniquely configured latch element which also functions as a hanger member for hanging the frame on a wall or the like. The latching element includes latching fingers that are continuously biased toward a locking position so as to prevent accidental separation of the top of the frame from the frame body.

17 Claims, 3 Drawing Sheets

PICTURE FRAME

BACKGROUND OF THE INVENTION

1. Field of the Invention

The present invention relates generally to picture frames. More particularly, the invention concerns a picture frame in which a novel latch and hanger element functions to releasably interconnect the sides and backing member of the frame to form a closed unit.

2. Discussion of the Invention

A highly successful picture frame assembly has been manufactured by the present inventor for some time. This prior art structure comprises a plastic molding that is permanently attached to a plastic backing on three sides to form a frame body. The frame also includes a fourth side that slides on and off. The fourth side of the frame is maintained in place by a press fit closure arrangement with the frame backing. Under normal use this prior art frame structure performs in a very satisfactory manner. However, if the frame is roughly handled, or if an attempt is made to hang the frame from the fourth side, the fourth side may accidentally separate from the frame body. It is the solution of this frame separation problem to which the present invention is directed.

In seeking to solve the problem discussed in the proceeding paragraph an attempt was made to secure the fourth side of the frame to the frame body using a hook and eye type fabric sold under the registered trademark VELCRO. This solution proved less than totally successful. Another approach to the solution of the problem was to use an adhesive tape to secure the fourth side to the frame body. This approach also proved unsatisfactory and it was determined that some type of mechanical latch would have to be developed. The unique configuration and mode of operation of the combination latch and hanger element devised by the present inventor lies at the heart of the invention. The details of construction and operation of this element will be described in greater detail in the paragraphs which follow.

SUMMARY OF THE INVENTION

It is an object of the present invention to provide a novel picture frame construction in which one side of the frame is removably secured in place by a uniquely configured latch element which also functions as a hanger member for hanging the frame on a wall or the like.

Another object of the invention is to provide an improved picture frame of the aforementioned character in which the latch element is affixed to the frame body for cooperative interaction with a reinforcing member which is in turn interconnected with the removable top side of the frame.

Another object of the invention is to provide an improved picture frame of the class described in which the latch element can be inexpensively formed from a yieldably deformable, injection moldable plastic material.

Still another object of the invention is to provide an improved picture frame in which the latching element includes latching fingers that are continuously biased toward a locking position so as to prevent accidental separation of the top of the frame from the frame body.

Yet another object of the invention is to provide a latching element of the character described in the preceding paragraph which includes dual locking fingers that are closely received within precisely configured, spaced apart apertures formed in the top frame reinforcing member.

Another object of the invention is to provide a picture frame construction in which a second hanger element is provided so that the picture can be hung in either a horizontal or vertical configuration.

Another object of the invention is to provide a highly durable, light weight picture frame construction that is inexpensive to manufacture and can be easily assembled without the need for tools of any kind.

DESCRIPTION OF ONE FORM OF THE INVENTION

Figure 1:
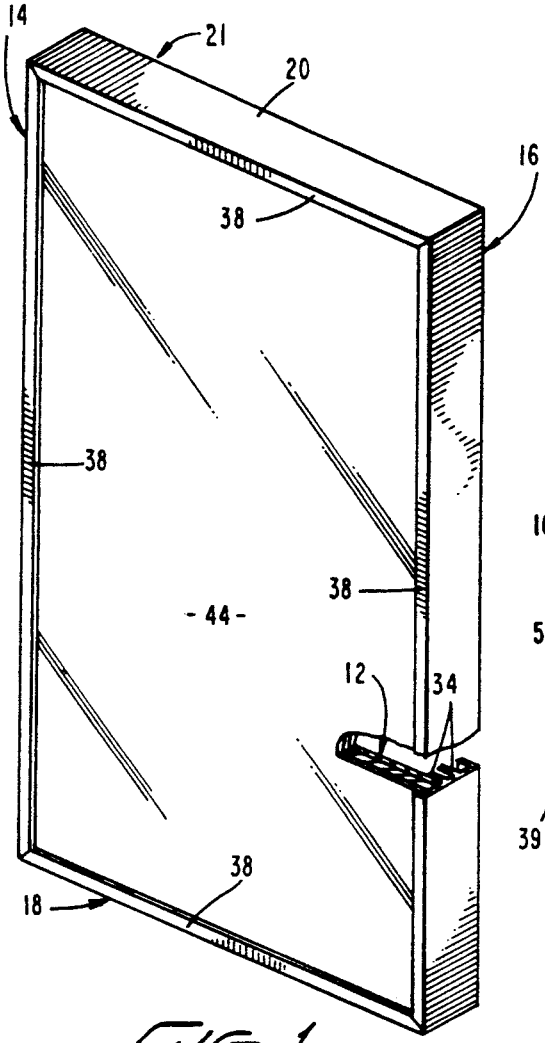
FIG. 1 is a generally perspective front view of the improved picture frame partly broken away to show internal construction.

Referring to the drawings and particularly to FIGS. 1, 2, 3 and 4, the improved picture frame of the present invention comprises a generally planar backing member 12 and first, second and third sides 14, 16 and 18 respectively which are connected to said backing member 12 to form a frame body. The improved picture frame also includes a fourth side 20 which is connected to a reinforcing member 22 to form a fourth side assembly 21 which can be removably connected to the frame body in the manner illustrated in FIG. 3.

Figure 9:
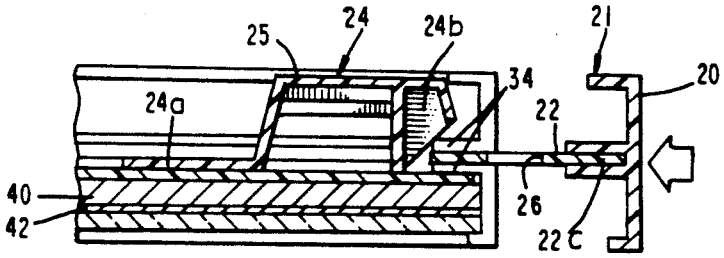
FIG. 9 is a fragmentary cross-sectional view of the upper portion of the frame illustrating the manner of assembly of the top of the frame to the frame body.
Figure 10:
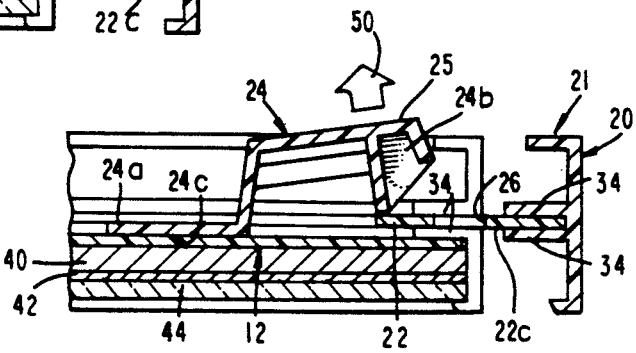
FIG. 10 is a fragmentary cross-sectional view similar to FIG. 9 but illustrating the movement of the latching element as the top of the frame is mated with the frame body.

An important feature of the improved picture frame of the present invention is a uniquely configured, combination latch and hanger element generally designated in the drawings by the numeral 24. As best seen in FIG. 3, latch element 24 includes a body portion **24*a* having a planar surface 24*c* which is connected to backing member 12 and further includes a pair of transversely spaced apart latching fingers 24*b*. Latch element 24 is preferably constructed of a yieldably deformable plastic material so that fingers 24*b* can be yieldably deformed from an at rest first position shown in FIG. 9 to an upraised second position shown in FIG. 10. As indicated in the drawings, reinforcing member 22 is provided with a pair of transversely spaced apertures 26 which are located so as to index with and closely receive fingers 24*b* when the fourth side assembly 21 is in the locking position shown in FIGS. 1 and 2 of the drawings. The manner of operation of the latching element 24 will be described in greater detail in the paragraphs which follow. However, it should be noted that element 24 is also provided with an aperture 28 adapted to receive a wall hanging nail or fastener 30 of the character shown in FIG. 4. The upper edge of the aperture is provided with small teeth 27** to assist in positioning the frame in a hanging position.

As best seen by referring to FIG. 3, backing member 12 is provided with first, second and third edge portions 12*a*, 12*b* and 12*c* respectively. These edge portions are connected to the forward facing walls 32 of guide means provided on frame sides 14, 16 and 18 (see also FIG. 4). The guide means function to closely receive edge portions 22*a* and 22*b* of reinforcing member 20 when the fourth side assembly 21 is moved into the frame closing position shown in FIGS. 1 and 2. The guide means of the embodiment of the invention shown in the drawings comprise a pair of inwardly protruding ribs or walls 34 provided on each of the first, second and third sides, 14, 16 and 18. Walls 34 are spaced apart a sufficient distance to form a slot or guide 34*a* which has a width slightly greater than the width of reinforcing member 22. As indicated in FIG. 3, the fourth side or top 20 is also provided with inwardly protruding walls 34 which are spaced apart so as to closely receive the upper edge 22*c* of reinforcing member 22. Preferably this upper edge of reinforcing member 22 is held permanently in place between walls 34 of side 20 by any suitable means such as adhesive.

Turning to FIGS. 1 and 3, each of the four frame sides 14, 16, 18 and 20 is provided with a front flange disposed in a spaced apart relationship with walls 34 and slots 34*a*. The space provided between the front most walls 34 and the front flanges 38 is such as to closely receive backing member 12, a mat 40, the painting illustration, or photograph 42 which is to be framed, and a generally planar transparent member such as a sheet of glass 44 which compresses the painting illustration, or photograph 42 against the mat 40. It is apparent from a study of FIG. 3 that when the top frame assembly 21 is removed from the frame body, the mat 40, the member to be framed 42 and the glass member 44 can be conveniently slid into position between the front face of backing member 12 and the rear face of flange 38.

In practice the sides of the frame are preferably cut from a long length of an extrudable plastic such as styrene, which has been formed in the channel-like configuration illustrated in FIG. 3. The inwardly "E" shaped, protruding walls 34, the front flange 38 and the rear flange 39 are all preferably formed integrally with the outer wall of the frame to produce the configuration best seen at the left of FIG. 3. During the cutting operation, the corners are mitered in the manner shown in FIG. 3. After the sides are cut the backing member 12 are suitably interconnected with sides 14, 16, and 18 by solvent or adhesive bonding of edges 12*a* of the backing member to the forward faces of the forward most inwardly protruding walls 34 of the side member by any suitable bonding means. This forms a rigid three sided frame body of the character illustrated in the lower portion of FIG. 3 with the lower mitered edges 14*a* and 16*a* of frame members 14 and 16 in close engagement with the mitered corners 18*a* of side 18.

Figure 6:
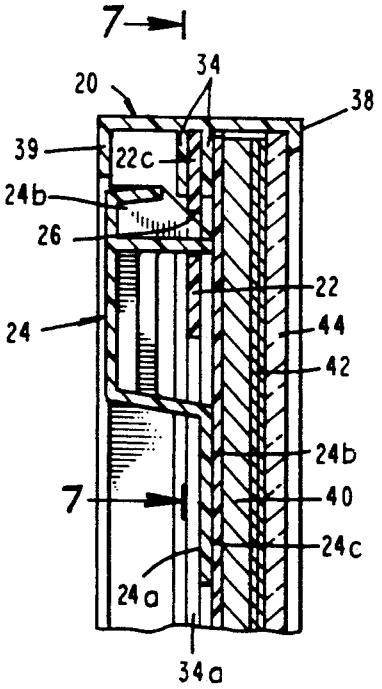
FIG. 6 cross-sectional view taken along lines 6—6 of FIG. 5.
Figure 7:
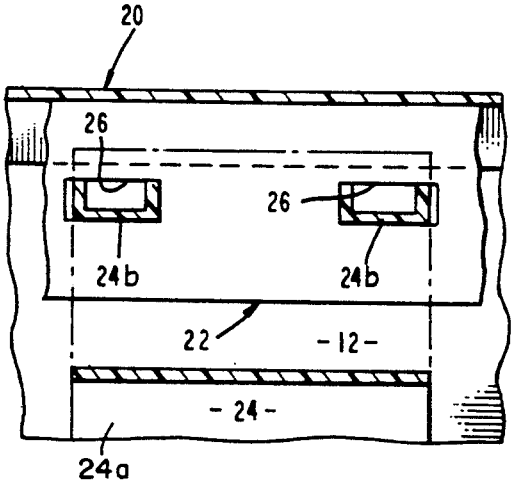
FIG. 7 is a cross-sectional view taken along lines 7—7 of FIG. 6.

Following assembly of the frame body, latch element 24 is interconnected with backing member 12 by bonding of portion 24*a* of the latch element to the backing member 12 by any suitable bonding means. Latch element 24 is centered relative to backing member 12 and is precisely positioned so that when the top side member 20 is slid into a mating relationship with the frame body fingers 24*b* of the latch element will be lockably received within apertures 26 formed in reinforcing member 22 (See FIGS. 6 and 7). This done, mat 40, the member to be displayed 42 and glass member 44 can be slid into position between backing member 12 and flange 38. (FIG. 3).

Next edge 22*a* of reinforcing member 22 is inserted between inwardly protruding walls 34 of side 20 and is affixed in place by use of an adhesive or other suitable means. The assemblage thus formed is then mated with the frame body by inserting the sides 22*a* and 22*b* of reinforcing member 22 into guides or slots 34*a* formed intermediate inwardly protruding walls 34 provided on sides 14 and 16. As best seen by referring to FIGS. 9 and 10, as the fourth side assembly 21 is moved into mating position, the upper portion 25 of the latching element is resiliently deformed upwardly in the manner shown by the arrow 50 in FIG. 10. During this mating step finger 24*b* of the latching element will ride over reinforcing member 22 until the fingers, which are now biased in a downwardly direction, index with apertures 26 formed in reinforcing member 22. At this point fingers 24*b* will fall into apertures 26 thereby locking the fourth frame assembly into the correct mating position with the frame body in the manner shown in FIG. 1.

Figure 4:
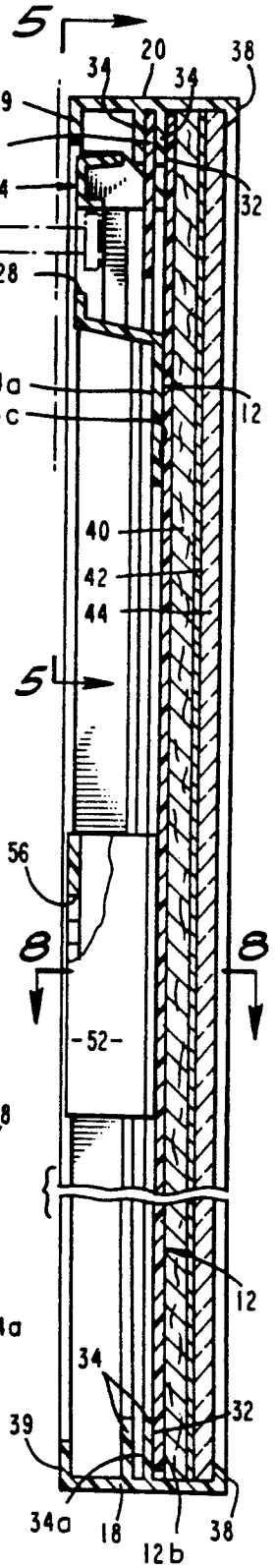
FIG. 4 is an enlarged cross-sectional view taken along lines 4—4 of FIG. 2.
Figure 5:
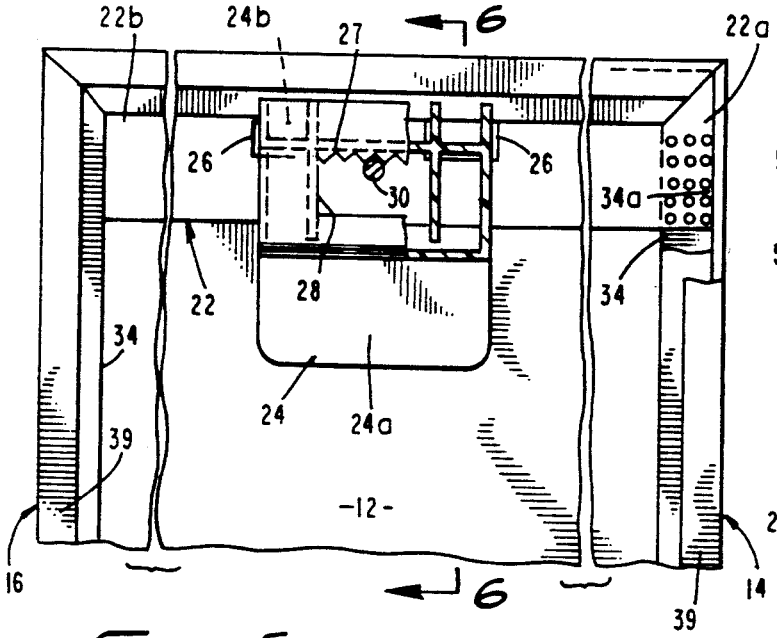
FIG. 5 is a view taken along lines 5—5 of FIG. 4.

With the improved picture frame assembled in the manner discussed in the preceding paragraph, latch element 24 functions not only to maintain the fourth side assembly in engagement with the frame body, but also functions as a hanger element for hanging the picture frame on a fastener such as nail 30. (FIG. 4)

To change the member being displayed the upper portion of the latch element can be lifted, the fourth side assembly 21 separated from the frame body and the displayed member readily removed and replaced.

Figure 2:
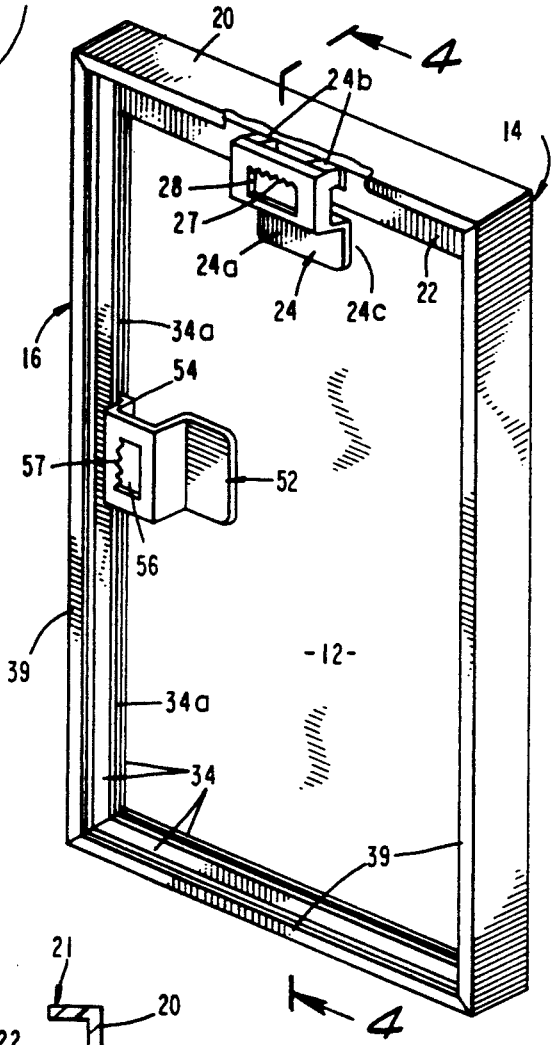
FIG. 2 is a generally perspective rear view of the improved picture frame.
Figure 3:
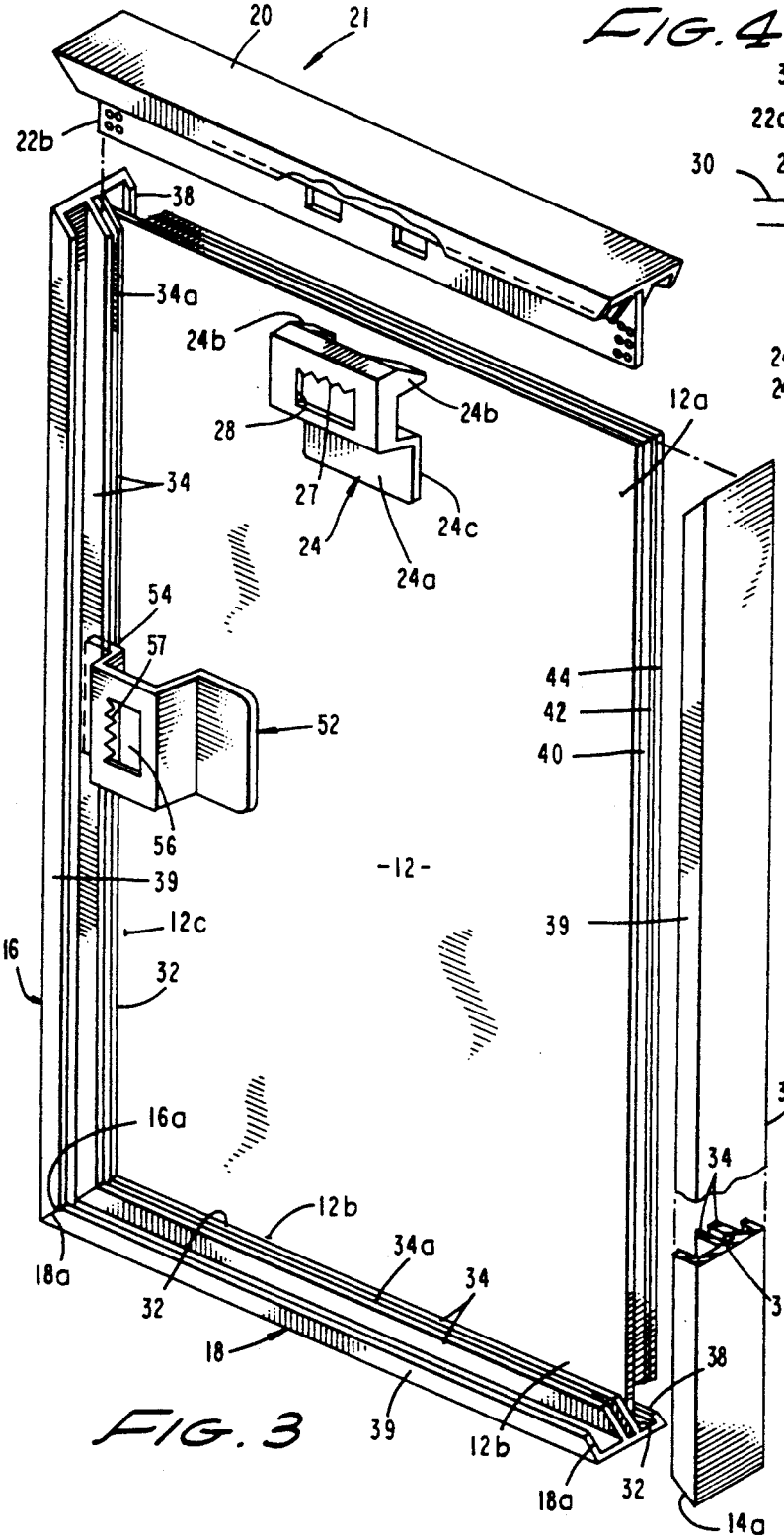
FIG. 3 is an enlarged exploded perspective view of the improved picture frame showing the manner of separation of the top frame element from the frame body.
Figure 8:
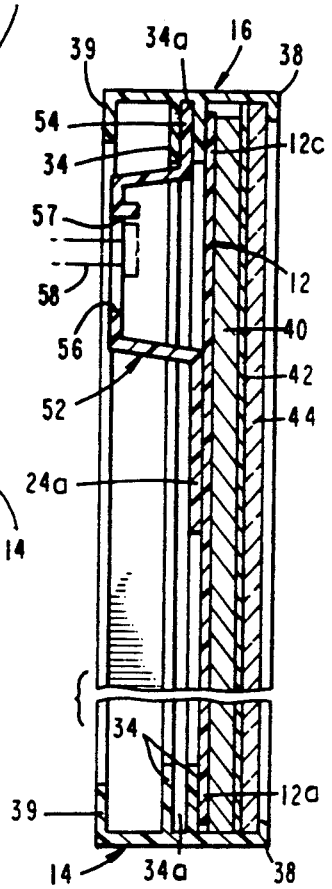
FIG. 8 is a cross-sectional view taken along lines 8—8 of FIG. 4.

In the form of the invention shown in the drawings, a second hanger member 52 is interconnected with backing member 12 in the manner shown in FIG. 2. Hanger member 52 is of similar construction to hanger member 24 but does not include fingers 24*b*. Rather, hanger member 52 is provided with a flange portion 54 which is closely receivable within guide or slot 34*a* provided in side member 16. Like member 24, hanger 52 is provided with an aperture 56 having teeth 57 which adapted to receive a fastener such as a nail 58 in the manner shown in FIG. 8 of the drawings. With this arrangement the improved picture frame can be hung either in the vertical orientation shown in FIG. 1 or in a horizontal orientation wherein hanger element 52 is used to support the frame on nail 58.

Having now described the invention in detail in accordance with the requirements of the patent statutes, those skilled in the art will have no difficulty in making changes and modifications in the individual parts or their relative assembly in order to meet specific requirements or conditions. Such changes and modifications may be made without departure from the scope and spirit of the invention, as set forth in the following claims.

I claim:

1. An improved picture frame comprising:

(a) a backing member;

(b) first, second and third sides connected to said backing member to form a frame body;

(c) a fourth side assembly removably connected to said frame body, said fourth side assembly including:

(i) a fourth side; and (ii) a reinforcing member connected to said fourth side said reinforcing member having at least one aperture; and (d) a latch element having:

(i) a body portion connected to said backing member; and (ii) at least one latching finger lockably receivable within said aperture of said reinforcing member of said fourth side assembly.

2. An improved picture frame as defined in claim 1 in which at least two of said first, second and third sides includes a guide and in which said reinforcing member is receivable within said guides formed in said at least two sides.

3. An improved picture frame as defined in claim 2 in which said reinforcing member is generally planar.

4. An improved picture frame as defined in claim 3 in which said reinforcing member is provided with a pair of spaced apart apertures.

5. An improved picture frame as defined in claim 4 in which said latch element includes a pair of spaced apart latching fingers lockably receivable within said pair of apertures.

6. An improved picture frame as defined in claim 5 in which each of said latching fingers of said latch element includes a generally perpendicularly extending surface movable into frictional engagement with said reinforcing member.

7. An improved picture frame as defined in claim 6 in which a portion of said reinforcing member is receivable within said guides formed in said first and second sides.

8. An improved picture frame as defined in claim 7 in which said fourth side is provided with a guide and in which said reinforcing member is closely receivable therewithin.

9. An improved picture frame as defined in claim 8 in which said body portion of said latch element is provided with an aperture.

10. An improved picture frame comprising:

(a) a generally planar backing member having first, second, third and fourth edge portions;

(b) first, second and third sides connected to said first, second and third edge portions of said backing member to form a frame body, each said side having a slot formed therein;

(c) a fourth side assembly removably connected to said frame body, said fourth side assembly including:

(i) a fourth side having a slot formed therein; and (ii) a generally planar reinforcing member having a first edge portion receivable within said slot of said fourth side member, said reinforcing member having at least one aperture; and (d) a latch element having:

(i) a body portion having an aperture formed therein and being connected to said backing member; and (ii) at least one yieldably deformable latching finger lockably receivable with said aperture of said reinforcing member of said fourth side assembly.

11. An improved picture frame as defined in claim 10 in which said reinforcing member includes second and third edge portions receivable within the slots formed in said first and second sides.

12. An improved picture frame as defined in claim 10 in which said reinforcing member is provided with a pair of spaced apart apertures.

13. An improved picture frame as defined in claim 12 in which said latch element includes a pair of spaced apart latching fingers lockably receivable within said pair of apertures.

14. An improved picture frame comprising:

(a) a generally planar backing member having first, second, third and fourth edge portions;

(b) first, second and third sides connected to said first, second and third edge portions of said backing member to form a frame body, each said side having a slot formed therein and a front flange disposed in a spaced apart relationship with said slot;

(c) a fourth side assembly removably connected to said frame body, said fourth side assembly including:

(i) a fourth side having a slot formed therein and a front flange disposed in a spaced apart relationship with said slot; and (ii) a generally planar reinforcing member having a first edge portion receivable within said slot of said fourth side member, said reinforcing member having at least one aperture;

(d) a latch element having:

(i) a body portion having an aperture formed therein and being connected to said backing member; and (ii) a pair of spaced apart, yieldably deformable latching fingers lockably receivable with said apertures of said reinforcing member of said fourth side assembly; and (e) a generally planar transparent member disposed between said slots in said first, second, third and fourth sides and said front flanges on said first, second, third and fourth sides.

15. An improved picture frame as defined in claim 14 in which said reinforcing member includes second and third edge portions receivable within the slots formed in said first and second sides.

16. An improved picture frame as defined in claim 15 in which each of said latching fingers of said latch element includes a generally perpendicularly extending surface movable into frictional engagement with said reinforcing member.

17. An improved picture frame as defined in claim 15 further including a hanger element affixed to said backing member at a spaced apart location from said latch element.

* * * * *